United States Patent [19]

Kramer

[11] 4,350,324

[45] Sep. 21, 1982

[54] METHOD OF REMOVAL OF SLAG DEPOSITS FROM THE BOTTOM OF A FURNACE

[75] Inventor: Petrus J. A. Kramer, Oudkarspel, Netherlands

[73] Assignee: Estel Hoogovens B.V., IJmuiden, Netherlands

[21] Appl. No.: 217,105

[22] Filed: Dec. 16, 1980

[30] Foreign Application Priority Data

Dec. 17, 1979 [NL] Netherlands ..... 7909062

[51] Int. Cl.[3] ..... B08B 7/04

[52] U.S. Cl. ..... 266/44; 75/24; 75/27; 134/5; 264/30; 266/135

[58] Field of Search ..... 266/44, 227, 135, 249; 264/30; 134/5; 75/27, 24; 432/4

[56] References Cited

U.S. PATENT DOCUMENTS

| | | | |
|---|---|---|---|
| 3,102,055 | 8/1963 | Fajgen et al. | 134/5 |
| 3,222,222 | 12/1965 | Nakahara | 432/4 |
| 3,370,654 | 2/1968 | Skendrovic | 266/135 |

FOREIGN PATENT DOCUMENTS

| | | | |
|---|---|---|---|
| 729267 | 4/1980 | U.S.S.R. | 75/24 |

*Primary Examiner*—M. J. Andrews
*Attorney, Agent, or Firm*—Jon M. Lewis

[57] ABSTRACT

Slag deposited on the bottom of a steel making furnace, especially a soaking pit for steel ingots, is difficult to remove. To enable this to be done while the furnace is hot, it is now proposed to supply a substance, e.g. ferro-silicon, which lowers the melting point of the slag, and a substance which reacts exothermically to initiate melting of the slag. When the slag is sufficiently liquefied, it is removed by means of a mechanical grab.

5 Claims, No Drawings

METHOD OF REMOVAL OF SLAG DEPOSITS FROM THE BOTTOM OF A FURNACE

BACKGROUND OF THE INVENTION

1. FIELD OF THE INVENTION

This invention relates to a method of removal of slag deposits from the bottom of a furnace. The invention is especially advantageous when applied to the soaking pits in which steel ingots are heated for rolling into slabs, but in principle is applicable to other furnaces employed in the iron and steel industry. The invention will be described here mainly in relation to soaking pits.

2. DESCRIPTION OF THE PRIOR ART

Scale formed on the ingots falls off in the soaking pit and forms slag deposits on the bottom of the pit. The deposits build up with continued use of the pit so that the bottom surface of the pit rises. This brings the ingots closer to the flames at the top of the pit, so that the rate of scale formation increases.

It is known to try to remove loose deposits by means of a mechanical grab, but most deposits become sintered and cannot be removed in this manner. It is the current practice to take the pit out of operation, when the bottom surface rises too high, and to loosen the slag with pneumatic drills to enable its removal. This is a highly unsatisfactory procedure. It is expensive in labor. The pit must be allowed to cool for six days and, in order to avoid damage by thermal expansion, must be reheated slowly over ten days. There is thus a considerable need for a removal process which does not require cooling down of the furnace. No successful process of this kind has hitherto been developed.

The prior art contains various proposals. U.S. Pat. No. 4,165,065 describes, with particular reference to open hearth and electric furnaces, a process of adding a melting point lowering substance (especially alumina) to a still hot build-up of lime and then applying further heat to liquefy the combined material so that it can be drained away. Likewise U.S. Pat. No. 4,018,622 proposes removal of dusts, slag etc. in copper smelting furnaces by means of special fluxes which form a flowable glass. U.S. Pat. No. 3,365,523 describes the addition of fluxing material to the combustion chamber of a burner directed against slag in a furnace; presumably the furnace is generally cooled previously. DE NO. 711297 (1940) is concerned with the removal of iron oxide slags from pusher furnaces for rolling mills, by adding a mixture of solid fuel and oxygen-providing material to produce liquefaction.

SUMMARY OF THE INVENTION

It is the object of the present invention therefore to provide a method of removal of slag deposits from especially a soaking pit for ingots, which method is performed with the minimum of disruption of the normal operation of the pit.

The invention as claimed provides a solution. In particular the invention has two features which contrast with the prior art proposal mentioned above. First, not only is a melting point lowering substance added, but a heat-generating material performing an exothermic chemical reaction is then added to initiate melting of the slag locally. Once melting has started locally, it spreads through the slag body.

Second, the slag is removed by means of a mechanical grab. For this purpose it must be brought to the appropriate viscosity, and thickener material, e.g. fluorspar, may be added to achieve this. A mechanical grab fitted to the tongs of the crane of a battery of soaking pits may be employed conveniently.

The preferred melting point lowering substance is ferro-silicon. The effectiveness of this material is surprising because previously ferro-silicon has been found to be ineffective in soaking pits since it only combines with slag in the liquid state. Any other material which has a melting point lowering effect on the slag and which can be caused to liquefy the slag under the conditions created in the process, may be used instead of ferro-silicon.

Any suitable material which, when added to the slag, performs a chemical reaction producing considerable heat may be used as the exothermic material. Preferred is a material containing finely divided Al and $Fe_2O_3$ which react together. One example of the invention will now be given.

EXAMPLE

The bottom of a soaking pit of 120 tons capacity and normally operated at about 1300° C. (1300°–1340° C. in this case) had risen too high, in spite of steps taken between each charge to remove loose slag. Removal as described below was carried out without prior cooling from the working temperature.

On the soaking pit bottom a layer of Fe Si was scattered. About 400 kg of Fe Si packed in plastic or paper bags of about 10 kg each were put ready near the pit oven. The pit cover is rolled away and the bags thrown into the pit. The Fe Si was evenly spread over the bottom, but not too close to the walls. As the pit was about 5 meters deep and the bags were thrown in, no bags reach the side of the bottom from which they are thrown. To throw the last bags to the correct place, the soaking pit grab can be hung (in its open position) over the pit. By throwing the bags of Fe Si against the grab, the Fe Si will fall vertically and thus come to the right place. When all the Fe Si was thrown into the pit, the cover was closed and the pit heated to operation temperature.

Meanwhile about 300 kg of exothermic powder (see below) was put ready near the pit. This powder was in tight bags of about 10 kg each. When the pit was thoroughly heated, the cover was opened again. The bags of exothermic powder were now thrown (in the same manner as the Fe Si) into the pit. This should be done very quickly, as a vigorous fume development takes place. As the powder is in bags, it comes to lie in small heaps on the bottom. The powder burns and yields an enormous heat, so that the Fe Si under these heaps melts. Also a little slag melted, whereby mixing of the slag and Fe Si took place. Hence a puddle of aggressive slag is created which at sufficient heat will dissolve the rest of the bottom. As the heated powder forms a heat-insulating foam layer, not too much should be used, since otherwise the foam layer will prevent spreading of the melting.

During throwing of the exothermic powder, it is recommended to open the waste gas valve to remove most of the smoke by suction. When all exothermic powder has been thrown, the cover was closed as soon as possible. The waste gas valve was then closed as the very considerable heat developed would, if the valve is open, damage the fume channels. After some minutes the main part of the exothermic powder had reacted and the waste gas valve was opened again and the burners of the pit were lit.

The oven was then fired to its operational temperature of 1340° C. and kept for some hours at that temperature.

After 4 hours, inspection was made to see whether the Fe Si has performed its job well. A good result is that the liquefied layer is at least 10 cm thick, but 20 to 25 cm is better. The depth of the liquid can be gauged by means of the crane tongs or grab. If the results are not good enough, the pit can be heated for somewhat longer. If the bottom is not liquefied, or is only a little liquefied then some more bags of exotherm powder can be thrown.

When the slag was liquefied to an adequate depth, it is removed by means of the mechanical grab attached to the soaking pit crane. This grab is of generally conventional having two jaws which pivot to open and shut. If the slag was too liquid, so that it will tend to run out of the grab while being carried, it was rendered more viscous by means of a thickener material, in the present example, fluorspar. A grab load of fluorspar was then thrown into the slag and stirred in by means of the grab. (To prevent explosion, dry fluorspar must be used). When removing the slag, it is better to start at the sides, to prevent the middle of the pit bottom being hollowed out.

The exothermic powder material used was that known under the trade name "Steibit 704" made by Produits Metallurgie Doittau S.A. of 91100 Corbeil-Essones, France. This contains principally Al (about 20%) and $Fe_2O_3$ which react to produce heat.

What is claimed is:

1. In a method of removal of slag deposits from the bottom of a furnace wherein a substance capable of lowering the melting point of the slag is supplied to the slag, heat is applied to the slag and the slag is then removed, the improvement that:

in addition to the same melting point-lowering substance, a substance which performs an exothermic chemical reaction is supplied locally so as to initiate melting of the slag, and the slag is thereafter brought to a condition of fluidity which allows its removal by means of a mechanical grab, and said furnace is a soaking pit of a slabbing mill, operating at about 1300° C.

2. A method of removal of slag deposits from the bottom of a soaking pit for steel ingots, comprising the steps of (a) while the pit is still hot from operation, supplying ferro-silicon to the slag, (b) supplying locally to the slag a substance comprising materials which perform an exothermic chemical reaction so as to initiate melting of the slag due to the lowering of the melting point, (c) bringing the slag to a condition of fluidity which allows its removal by means of a mechanical grab, and (d) removing the liquefied slag by means of a mechanical grab.

3. A method according to claim 2 wherein, after melting of the slag, a thickening substance is added to decrease the fluidity of the slag in order to allow its removal by the mechanical grab.

4. A method according to claim 2 wherein the furnace is a soaking pit of a slabbing mill operating at about 1300° C.

5. A method according to claim 2 wherein the said substance which performs an exothermic reaction contains finely divided Al and $Fe_2O_3$ which burn together to produce heat.

* * * * *